US005143431A

United States Patent [19]

Udell

[11] Patent Number: 5,143,431

[45] Date of Patent: Sep. 1, 1992

[54] PORTABLE CORRUGATED CARDBOARD MEDICINE CABINET

[75] Inventor: Margo W. Udell, Skokie, Ill.

[73] Assignee: Medique Products Co., Skokie, Ill.

[21] Appl. No.: 537,027

[22] Filed: Jun. 12, 1990

[51] Int. Cl.[5] ..... A47B 43/02

[52] U.S. Cl. ..... 312/259; 312/258; 229/120.24

[58] Field of Search ..... 229/120.24, 120.37, 229/120.38; 312/259, 258, 262

[56] References Cited

U.S. PATENT DOCUMENTS 2,012,132 8/1935 Koppelman et al. ..... 229/120.38
3,123,276 3/1964 Mairs ..... 229/120.38
3,263,894 8/1966 Matson ..... 229/120.38
3,960,313 6/1976 Sax .
4,007,869 2/1977 Stolkin .
4,012,996 3/1977 Stolkin .
4,463,997 8/1984 Denson ..... 312/259

*Primary Examiner*—Gerald A. Anderson
*Attorney, Agent, or Firm*—Rockey and Rifkin

[57] ABSTRACT

A cabinet formed from corrugated cardboard blanks in which a first blank forms a cabinet assembly having a back, top, bottom and sides and a movable cover. Second and third blanks form first and second shelving units in the cabinet assembly. Portions of the first blank and a fourth blank engage the second and third blanks to retain the blanks in the cabinet assembly in fixed positions.

10 Claims, 2 Drawing Sheets

FIG. 1
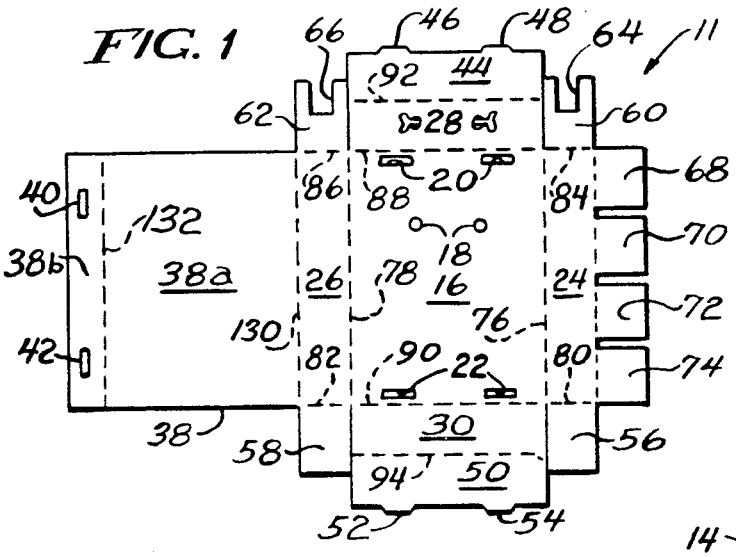
FIG. 2
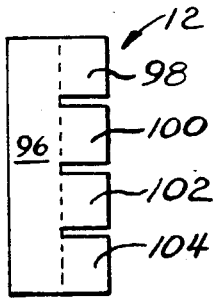
FIG. 3
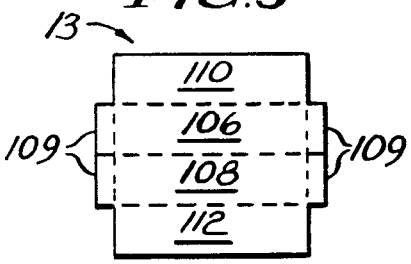
FIG. 4
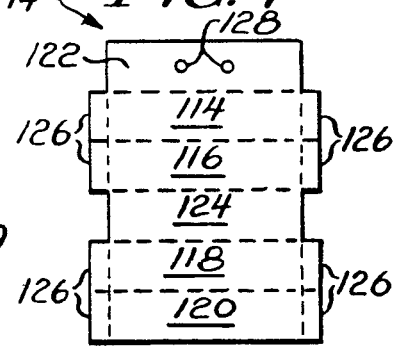
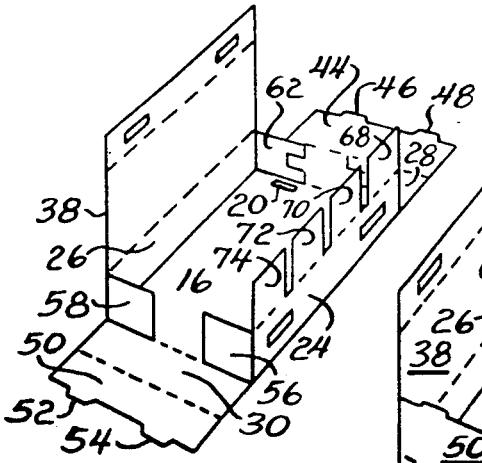
FIG. 5
FIG. 6
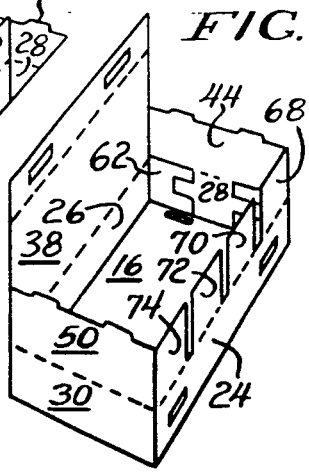
FIG. 7
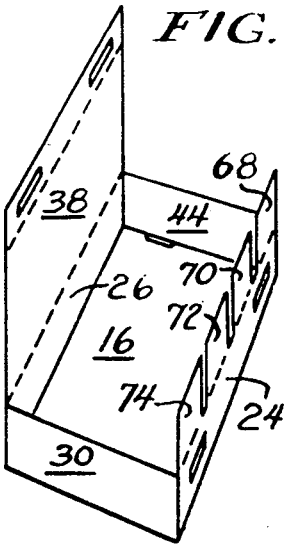

FIG. 8
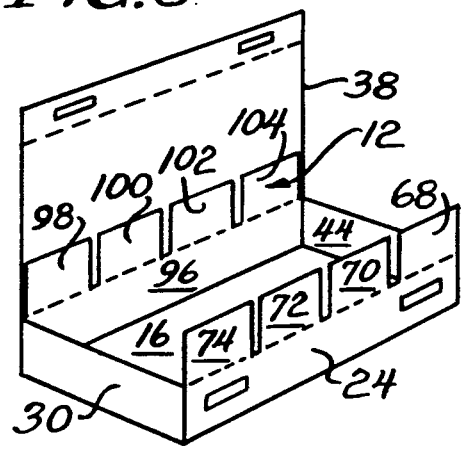
FIG. 9
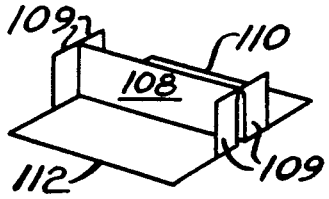
FIG. 10
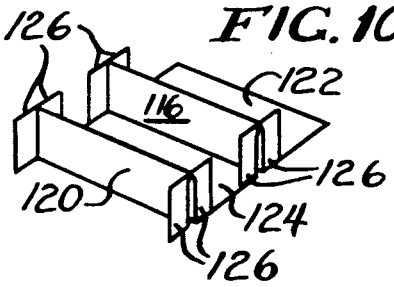
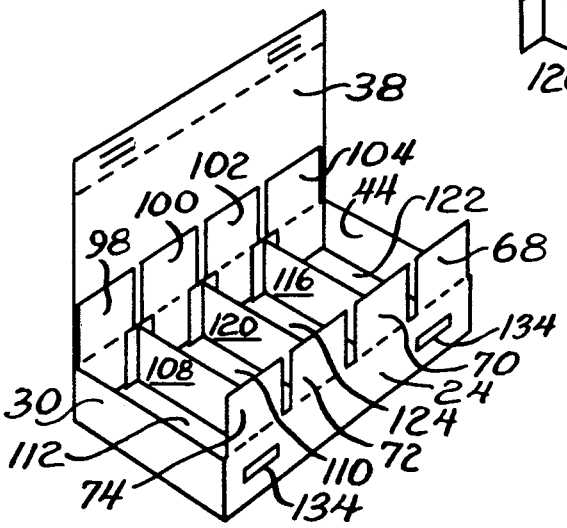
FIG. 11
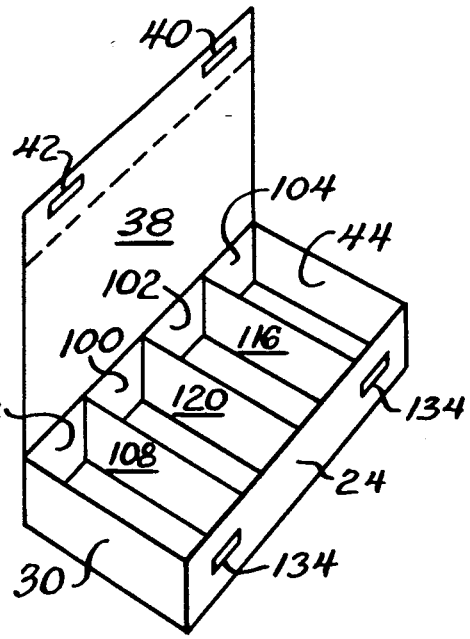
FIG. 12

PORTABLE CORRUGATED CARDBOARD MEDICINE CABINET

BACKGROUND OF THE INVENTION

This invention relates generally to carton construction and more particularly to carton constructions formed from corrugated cardboard blanks. The corrugated cardboard carton of the invention is particularly suitable for use as a portable medicine cabinet.

In industrial settings, on-site health care facilities are commonly provided where employees can be treated for minor injuries or ailments. Such facilities are also found in schools where students can be provided with temporary emergency medical care. These facilities typically include a medicine cabinet where drugs and other medical paraphernalia are stored. Because it is often necessary to provide treatment away from the facility, a medicine cabinet which is portable is desireable. Such a portable medicine cabinet should be of a lightweight and inexpensive construction.

OBJECTS AND SUMMARY OF THE INVENTION

It is a general object of the invention to provide a portable medicine cabinet.

It is a further object of the invention to provide a portable medicine cabinet having a lightweight yet rigid construction.

It is another object of the invention to provide a portable medicine cabinet which is inexpensive to manufacture.

It is a still further object of the invention to provide a portable medicine cabinet which can be quickly and easily assembled from corrugated cardboard blanks.

Other objects of the invention, in addition to those set forth above, will become apparent to one of ordinary skill in the art from the following description of the invention.

The invention, in summary, consists of a first corrugated cardboard blank which can be quickly and easily formed into a basic cabinet assembly. Separate cardboard blanks can be assembled in cooperation with the cabinet assembly to create shelving units defining a plurality of shelves. The assembled cabinet is designed to be releasably secured to a wall such that it can be removed from the wall and carried to a remote site. A handle is provided to facilitate the carrying of the cabinet.

BRIEF DESCRIPTION OF THE DRAWINGS

FIG. 1 shows a plan view of the corrugated cardboard blank used to form the cabinet assembly;

FIG. 2 shows a plan view of a corrugated cardboard blank used to install the shelving units in the cabinet assembly;

FIG. 3 shows a plan view of a corrugated cardboard blank used .to form the lower shelving unit;

FIG. 4 shows a plan view of a corrugated cardboard blank used to form the upper shelving unit;

FIGS. 5–12 show perspective views of the cardboard blanks as they are formed into the completed medicine cabinet.

DETAILED DESCRIPTION OF THE INVENTION

The medicine cabinet of the invention is assembled from the planar cardboard blanks 11, 12, 13 and 14, illustrated in FIGS. 1, 2, 3 and 4, respectively. The blanks are cut from corrugated cardboard, the weight of which will depend on the specific application requirements of the end user. The blanks are cut on machines known in the art using various die cutting devices and, if desired, various printing operations may be performed on the blanks. In the blanks shown in the figures, the solid lines represent the cut out portions of the blanks and the dashed lines represent the score lines where the blanks are to be folded.

Referring more particularly to FIG. 1, blank 11 includes a substantially centrally located rectangular rear panel 16. Located on rear panel 16 are a first pair of apertures 18 adapted to receive fasteners such that the assembled medicine cabinet can be removably suspended on a wall or other fixed support. The fasteners could include hooks, pegs or bolts secured to a wall and insertable into the apertures 18. Of course, other suitable fasteners could also be used to releasably secure the medicine cabinet to a wall or other fixed support. The rear panel 16 also includes a first pair of slotted apertures 20 and a second pair of slotted apertures 22 adapted to receive locking tabs as will hereinafter be described.

Extending from the top and bottom edges of the rear panel 16 are top and bottom panels 28 and 30, respectively. Top panel 28 includes two apertures 32 and 34 which receive and retain the ends of plastic handle 36. The handle 36 will be located on the top outer surface of the assembled cabinet to provide a convenient hand hold. Extending from top panel 28 is a first locking flap 44 having locking tabs 46 and 48 formed thereon. A second locking flap 50 extends from bottom panel 30 and has locking tabs 52 and 54 formed thereon.

Extending from the opposite side edges of rear panel 16 are side panels 24 and 26. Extending from side panel 26 is cover panel 38 consisting of a first portion **38*a* and a second portion 38*b*. First portion 38*a* has the same size and shape as rear panel 16. Second portion 38*b* has fasteners, such as Velcro TM strips, 40 and 42 fixed thereto to provide a closing means as will hereinafter be described. Attached to the bottom edges of side panels 24 and 26 are corner flaps 56 and 58, respectively. Attached to the top edges of side panels 24 and 26 are corner flaps 60 and 62, respectively. Corner flaps 60 and 62 include rectangular cut-outs 64 and 66, respectively, designed to accommodate the protruding ends of handle 36 in the assembled cabinet. Finally, extending from side panel 24 are four shelving flaps 68, 70, 72 and 74**.

To assemble the basic cabinet, side panels 24 and 26 are folded along score lines 76 and 78, respectively, until perpendicular to rear panel 16. And, corner flaps 56, 58, 60 and 62 are folded along score lines 80, 82, 84 and 86 such that blank 10 takes the configuration shown in FIG. 5.

The top panel 28 and bottom panel 30 are then folded along score lines 88 and 90 until perpendicular to rear panel 16, as shown in FIG. 6. Locking flaps 44 and 50 are folded along score lines 92 and 94 such that locking tabs 46 and 48 engage slots 20 and locking tabs 52 and 44 engage slots 22. In this configuration, shown in FIG. 7, the corner flaps 56 and 58 are trapped between the bottom panel 30 and locking flap 50 and corner flaps 60 and 62 are trapped between top panel 28 and locking flap 44 such that a secure cabinet assembly results.

Once the basic cabinet assembly of FIG. 7 is completed, it is necessary to assemble the shelving structure from the blanks illustrated in FIGS. 2–4. Blank 12, shown in FIG. 2, consists of a secondary side panel 96 having the same size and shape as side panel 26. Extending from secondary side panel 96 are four shelving flaps 98, 100, 102 and 104. Blank 12 is inserted into the assembled carton such that it lays parallel to and abuts side panel 26 and cover panel 38, shown in FIG. 8. It should be noted that shelving flaps 98, 100, 102 and 104 correspond to shelving flaps 68, 70, 72 and 74, respectively, having the same size and shape.

The lower shelving unit is assembled from blank 13, shown in FIG. 3. Blank 13 consists of two shelf panels 106 and 108 and two back panels 110 and 112. Extending from either end of shelf panels 106 and 108 are flaps 109. To assemble the lower shelving unit, flaps 109 are folded so as to extend perpendicularly to panels 106 and 108. The shelf panels 106 and 108 and back panels 110 and 112 are then folded accordion style, as shown in FIG. 9. As illustrated in FIG. 9, the shelf panels 106 and 108 abut one another and extend perpendicularly to the back panels 110 and 112. When the lower shelving unit is installed in the basic cabinet assembly, shelf panel pair 106, 108 will form the lower shelf, as will hereinafter be described.

The upper shelving unit is assembled from blank 14, illustrated in FIG. 4. Blank 14 has four shelf panels 114, 116, 118 and 120 and two back panels 122 and 124. Extending from either edge of each of the shelf panels are flaps 126. Back panel 122 has a pair of holes 128 formed therein which will be coextensive with holes 18 formed in the rear panel 16 when the shelving units are installed in the cabinet assembly. To assemble the upper shelving unit, flaps 126 are folded so as to extend perpendicularly to the shelf panels. Blank 14 is then folded, as shown in FIG. 4, such that shelf panels 118 and 120 abut one another and shelf panels 114 and 116 abut one another. When the upper shelving unit is installed in the basic cabinet assembly, shelf panel pairs 114, 116 and 118, 120 will form the two shelves of the upper shelving unit.

Once the upper and lower shelving units are assembled as illustrated in FIGS. 9 and 10, they can be installed in the basic cabinet assembly, as shown in FIG. 11. The lower shelving unit of FIG. 9 is placed in the cabinet assembly such that back panels 110 and 112 are parallel to abutting rear panel 16. The bottom edge of back panel 112 abuts bottom panel 30 and the flaps 109 abut side panel 24 and blank 12. The upper shelving unit of FIG. 10 is positioned in the cabinet assembly such that back panels 122 and 124 abut rear panel 16, flaps 126 abut blank 12 and side panel 24, and shelf panel 120 abuts the top edge of back panel 110.

The shelving flaps 68, 70, 72 and 74 of the basic cabinet assembly and shelving flaps 98, 100, 102 and 104 of blank 12 are dimensioned such that when folded over flaps 109 and 126 as shown in FIG. 12, they cooperate with the upper and lower shelving units to create a tight friction fit. Thus, the shelving units are retained in the basic cabinet assembly by the shelving flaps. It should be noted that a cabinet having a greater or lesser number of shelves may be assembled by using a greater or lesser number of the shelving units shown in FIGS. 9 and 10. Moreover, the distance between the shelves can be varied by changing the height of the back panels 110, 112, 124 and 122 and the corresponding sizes of the shelving flaps a desired.

The cover panel can be folded along score lines 130 and 132 such that portion 38*a* closes the cabinet and portion 38*b* extends over side panel 24. Side panel 24 is provided with fasteners 134 capable of releasably engaging the fasteners 40 secured to portion 38*b*. Thus, the cabinet can be securely closed.

Once the shelving units are secured in the cabinet assembly, the cabinet can be suspended on a wall or other support structure by fasteners releasably engaging the holes formed by apertures 18 and 122. The handle 36 provides a convenient means for removing the cabinet from the fasteners and carrying the portable cabinet.

While we have shown and described embodiments of this invention in some detail, it will be understood that this description and the accompanying drawings are offered merely by way of example, and that the invention is to be limited in scope only by the appended claims.

What is claimed is:

1. A cabinet formed from corrugated cardboard blanks, comprising:

a first blank assembled to form a cabinet assembly having a rear panel, a pair of opposed side panels, a top panel, a bottom panel and a movable cover panel defining an enclosable volume of space;

a second blank formed to define a first, upper shelving unit;

a third blank formed to define a second, lower shelving unit; and means for retaining said first and second shelving units in said volume of space including a fourth blank having a panel and a plurality of flaps inserted between said first and second shelving units and dimensioned such that a friction fit results between the fourth blank and the second and third blanks wherein a portion of said second and third blanks are trapped between said plurality of flaps and the panel of the fourth blank.

2. The cabinet according to claim 1, wherein said means for retaining includes a portion of said first blank engageable with said second and third blanks.

3. The cabinet according to claim 1, wherein said first shelving unit includes one shelf.

4. The cabinet according to claim 1, wherein said second shelving unit includes a plurality of shelves.

5. The cabinet according to claim 1, wherein said rear panel defines a first pair of apertures and said third blank defines a second pair of apertures arranged such that when said third blank is retained in said volume of space, the first and second pair of apertures are coextensive whereby holes are formed in the cabinet for releasably mounting the cabinet to a support.

6. The cabinet according to claim 1, wherein said portion of said first blank includes a further plurality of flaps inserted between shelves of the first and second shelving units and dimensioned such that a friction fit results between the first blank and the first and second shelving units.

7. The cabinet according to claim 6, wherein said further plurality of flaps extend from one of said pair of side panels such that a portion of said first and second blanks are trapped between said one of said pair of side panels and said plurality of flaps.

8. A cabinet formed from corrugated cardboard blanks, comprising:

a first blank assembled to form a cabinet assembly having a rear panel, a pair of opposed side panels, a top panel, a bottom panel and a movable cover panel defining an endurable volume of space;

a second blank assembled to form at least one shelving unit; and means for retaining said at least one shelving unit in said volume of space including a third blank having a panel and a plurality of flaps dimensioned such that a friction fit results between the third blank and the at least one shelving unit wherein a portion of said at least one shelving unit is trapped between said plurality of flaps and the panel of the third blank.

9. A corrugated cardboard cabinet, comprising:

a) a rear wall, a top wall connected to one side of said rear wall, a bottom wall connected to another side of said rear wall, and a pair of side walls connected to opposite sides of said rear wall forming a cabinet assembly defining an enclosable space;

b) a cover movably connected to one of said walls and having dimensions in conjunction with said walls, so as to enclose said space;

c) at least one shelving unit located in said space, extending substantially the distance between said side walls and consisting of a single cardboard blank having a first portion of said blank extending parallel to and abutting said rear wall, a second portion of said blank extending parallel to and abutting one of said side walls, a third portion of said blank extending parallel to the other side wall and a fourth portion of said blank extending perpendicularly to each of said first second and third portions to define a shelf; and d) means for engaging said at least one shelving unit to prevent movement of said shelving unit in all directions and to fix said at least one shelf in position relative to said cabinet assembly, and further including a panel and a plurality of flaps extending from said panel, said panel being disposed between said third portion and one of said side walls, said flaps contacting said at least one shelving unit.

10. The cabinet according to claim 9, wherein said third portion of said at least one shelving unit is trapped between said panel and said plurality of flaps extending therefrom.

* * * * *